US007878606B2

(12) United States Patent
Chen et al.

(10) Patent No.: US 7,878,606 B2
(45) Date of Patent: Feb. 1, 2011

(54) SLIDE ASSEMBLY HAVING AN AUTOMATIC RETRACTABLE DEVICE

(75) Inventors: Ken-Ching Chen, Kaohsiung Hsien (TW); Shih-Long Huang, Kaohsiung Hsien (TW); Shun-Ho Yang, Kaohsiung Hsien (TW); Xue-Long Liu, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 531 days.

(21) Appl. No.: 11/889,072

(22) Filed: Aug. 9, 2007

(65) Prior Publication Data

US 2008/0197759 A1 Aug. 21, 2008

(30) Foreign Application Priority Data

Feb. 17, 2007 (TW) ..... 096106429 A

(51) Int. Cl.
*A47B 95/00* (2006.01)
*A47B 88/00* (2006.01)

(52) U.S. Cl. ..... 312/333; 312/334.44

(58) Field of Classification Search ..... 312/333, 312/334.44–334.47, 334.7; 384/21
See application file for complete search history.

(56) References Cited

U.S. PATENT DOCUMENTS 5,015,048 A 5/1991 Brunnert
5,020,868 A 6/1991 Brunnert
5,040,833 A 8/1991 Brunnert
5,040,858 A 8/1991 Kruse et al.
5,207,781 A 5/1993 Rock
5,240,318 A 8/1993 Schroder et al.
5,302,016 A 4/1994 Lautenschlager et al.
5,364,179 A 11/1994 Brustle et al.
5,474,375 A 12/1995 Hollenstein et al.
5,580,138 A 12/1996 Grabher
6,254,205 B1 7/2001 Wright et al.
6,340,078 B1 1/2002 Scheible
6,629,738 B2 10/2003 Salice
6,652,050 B2 * 11/2003 Lin ..... 312/333
6,672,692 B2 1/2004 Weng
6,712,435 B2 3/2004 Kim et al.
6,733,097 B2 5/2004 Kim et al.
6,736,471 B2 5/2004 Lin
6,799,817 B1 * 10/2004 Chu ..... 312/333
6,846,053 B2 1/2005 Salice
6,848,759 B2 2/2005 Doornbos et al.

(Continued)

*Primary Examiner*—Darnell M Jayne
*Assistant Examiner*—Timothy M Ayres
(74) *Attorney, Agent, or Firm*—Rosenberg, Klein & Lee

(57) ABSTRACT

A slide assembly having an automatic retractable device includes a sliding member, a fixture, a locator, a guiding member provided on a sliding rail, and a stationary rail. The sliding member is slidably disposed in the stationary rail. The fixture is secured at the end of the stationary rail. The locator is disposed in the stationary rail. The sliding member is linked to a first elastic member which urges the sliding member back to the fixture. An engaging plate is provided on the sliding member. The engaging plate has a first end and a second end. The first end of the engaging plate is pivotally connected to the sliding member. An engaging rod is provided on the second end of the engaging plate. The engaging rod is guided to engage with the guiding member of the sliding rail or the locator of the stationary rail.

15 Claims, 18 Drawing Sheets

U.S. PATENT DOCUMENTS

| | | | | |
|---|---|---|---|---|
| 6,953,233 | B2 | 10/2005 | Lam et al. | |
| 6,971,729 | B1 | 12/2005 | Kim et al. | |
| 6,979,066 | B2 | 12/2005 | Yang | |
| 6,997,528 | B2 | 2/2006 | Yang | |
| 7,040,725 | B1 | 5/2006 | Mao-Chin | |
| 7,077,487 | B2 * | 7/2006 | Yang | 312/333 |
| 7,083,243 | B2 | 8/2006 | Lee | |
| 7,104,691 | B2 | 9/2006 | Chi | |
| 7,159,958 | B1 | 1/2007 | Lu | |
| 7,374,261 | B1 * | 5/2008 | Wang | 312/333 |
| 2004/0183411 | A1 * | 9/2004 | Boks | 312/333 |
| 2004/0239218 | A1 * | 12/2004 | Jurja | 312/333 |
| 2005/0104492 | A1 * | 5/2005 | Chiu | 312/333 |
| 2005/0231083 | A1 | 10/2005 | Garcie | |
| 2006/0017358 | A1 | 1/2006 | Sato et al. | |
| 2006/0043851 | A1 | 3/2006 | Lee | |
| 2006/0082266 | A1 | 4/2006 | Le et al. | |
| 2006/0108901 | A1 | 5/2006 | Mao-Chin | |
| 2006/0186772 | A1 | 8/2006 | Lam et al. | |
| 2006/0238089 | A1 | 10/2006 | Prentner et al. | |
| 2007/0001562 | A1 * | 1/2007 | Park | 312/333 |
| 2007/0046158 | A1 | 3/2007 | Hoffman | |
| 2007/0132346 | A1 | 6/2007 | Huang | |

* cited by examiner

SLIDE ASSEMBLY HAVING AN AUTOMATIC RETRACTABLE DEVICE

BACKGROUND OF THE INVENTION

1. Field of the Invention

The present invention relates to a slide assembly having an automatic retractable device, more particularly to a device which can assist a sliding member provided in a stationary rail in a slidable manner to retract to its original position automatically when a sliding rail is pushed inward.

2. Description of the Prior Art

Conventional drawers or the like use sliding rails to facilitate pulling and pushing the drawers. There are some products that provide an automatic retractable device which is to assist the drawers to back to a closed position. This function will be activated before the drawer reaching to the end.

Such designs can been found from the U.S. Pat. Nos. 5,015,048, 5,020,868, 5,040,833, 5,040,858, 5,207,781, 5,240,318, 5,302,016, 5,364,179, 5,474,375, 5,580,138, 6,254,205 B1, 6,340,078 B1, 6,629,738 B2, 6,652,050 B2, 6,672,692 B2, 6,712,435 B2, 6,733,097 B2; 6,736,471 B2, 6,799,817 B1, 6,846,053 B2, 6,848,759 B2, 6,953,233 B2, 6,971,729 B1, 6,979,066 B2, 6,997,528 B2, 7,040,725 B1, 7,077,487 B2, 7,083,243 B2, 7,104,691 B2, and 7,159,958 B1; Application Published Nos. 2004/0183411 A1, 2004/0239218 A1, 2005/0104492 A1, 2005/0231083 A1, 2006/0017358 A, 2006/0043851 A1, 2006/0082266 A1, 2006/0108901 A1, 2006/0186772 A1, 2006/0238089 A1, 2007/0001562 A1, 2007/0046158 A1, 2007/0132346 A1; and EU Patent No. 0743032 B1.

The present invention is to improve the product to make it more solid and to lower the cost of manufacture.

SUMMARY OF THE INVENTION

The present invention provides a slide assembly having an automatic retractable device to extend the lifetime of usage by a sliding member in the stationary rail to pull a sliding rail inwardly when the sliding rail reaches to the inner end of the stationary rail.

According to the present invention, there is provided a slide assembly having an automatic retractable device, comprising a stationary rail having a rail trough; a sliding rail slidably connected to said stationary rail; a sliding member disposed in said rail trough of said stationary rail in a slidable manner, said sliding member comprising a first elastic member and an engaging plate, said engaging plate comprising a first end, a second end, and an engaging rod, said first end of said engaging plate being pivotally connected to said sliding member, said engaging rod being disposed on said second end of said engaging plate; a fixture disposed at one end of said stationary rail, said fixture and said sliding member being connected by said first elastic member; a locator disposed in said stationary rail, said locator comprising a recess and a second inclined plane adjacent to said recess for said engaging rod of said engaging plate to be secured in said recess along said second inclined plane; and a guiding member disposed at an inner side of said sliding rail, said guiding member comprising a first inclined plane and protuberances for engagement of said engaging rod of said engaging plate.

Preferably, said fixture comprises a second elastic member corresponding to said second end of said engaging plate.

Preferably, said second elastic member is an elastic rod.

Preferably, said sliding member comprises a stopper corresponding to said second end of said engaging plate.

Preferably, the slide assembly having an automatic retractable device further comprises a buffer disposed either between said fixture and said sliding rail or between said fixture and said sliding member.

Preferably, said buffer is a resilient member.

Preferably, said buffer is a pneumatic buffer rod.

Preferably, the slide assembly having an automatic retractable device further comprises a magnetic element disposed either between said fixture and said sliding rail or between said fixture and said sliding member.

Preferably, the slide assembly having an automatic retractable device further comprises a damper and a gear chain, said damper comprising a case and a gear, said damper being disposed on said sliding member, said gear chain being disposed on said stationary rail, said gear of said damper meshing with said gear chain.

Preferably, said case of said damper is fixedly connected to said sliding member.

Preferably, one end of said case of said damper is pivotally connected said sliding member to facilitate engagement and disengagement of said gear chain and said gear.

Preferably, said sliding member comprises a restricting member corresponding to said case of said damper to confine swinging angle of said damper, said sliding member further comprising a resilient element corresponding to said damper.

Preferably, said case comprises an arc trough and a pin penetrating said arc trough to be secured to said sliding member.

Preferably, said gear chain is formed on a guiding rail, said guiding rail comprising a recess, a second inclined plane adjacent to said recess, and a second elastic member.

Preferably, said guiding rail is integrally formed with said fixture.

It is the primary object of the present invention to provide a slide assembly having an automatic retractable device, which has a simple structure and is cost-effective.

It is another object of the present invention to provide a slide assembly having an automatic retractable device, which provides a sliding member sliding along a rail trough in a steady manner and is more reliable.

It is a further object of the present invention to provide a slide assembly having an automatic retractable device, which is more durable and has a longer lifespan.

It is still a further object of the present invention to provide a slide assembly having an automatic retractable device, which is easy to change its style to be more functioning.

DETAILED DESCRIPTION OF THE PREFERRED EMBODIMENTS

Figure 1:
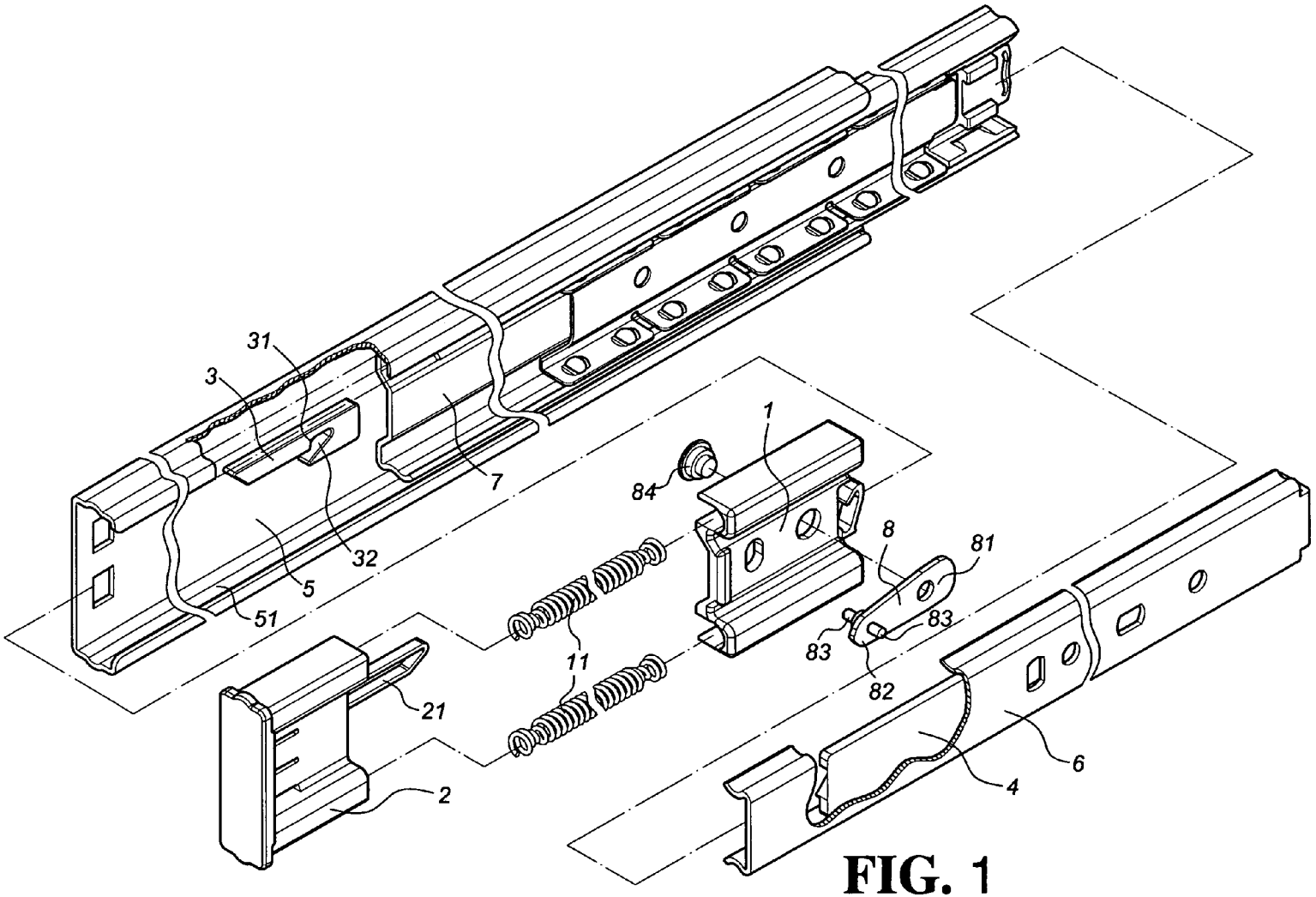
FIG. 1 is an exploded view of a preferred embodiment of the present invention (this embodiment comprises a stationary rail, a relay rail and a sliding rail)
Figure 2:
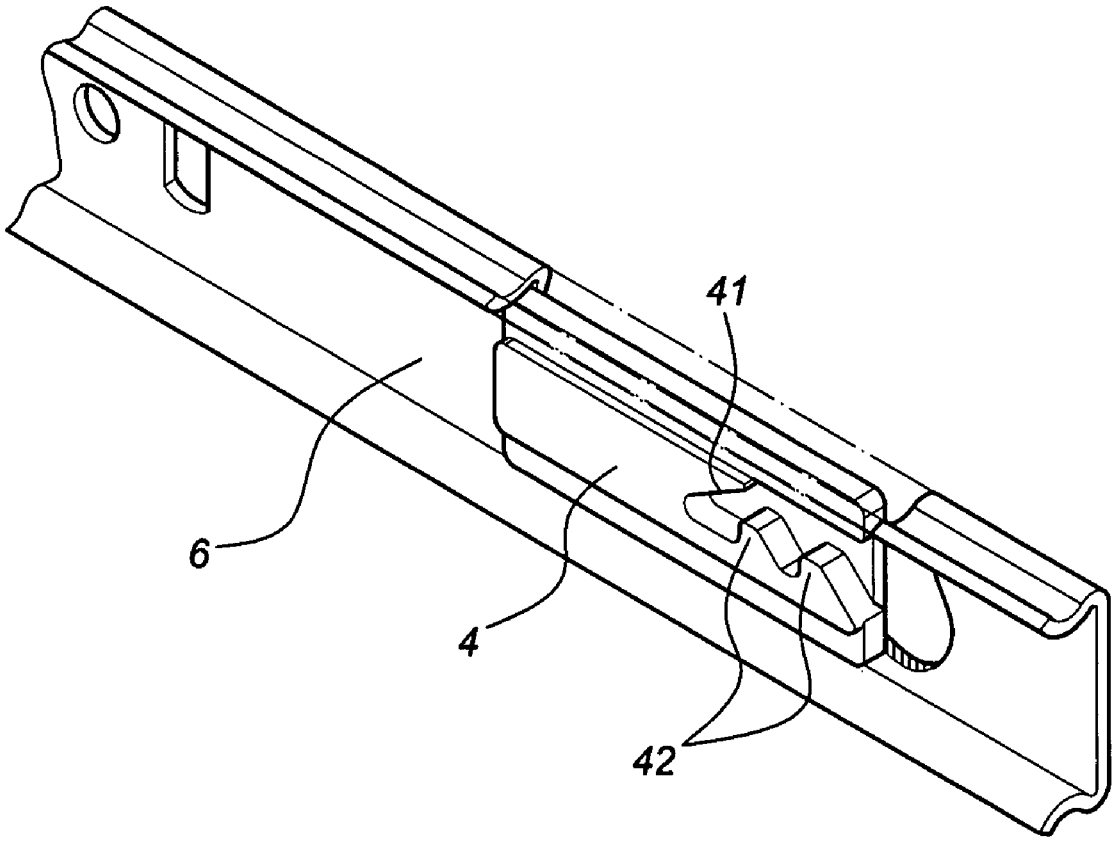
FIG. 2 is an enlarged view of a guiding member of the preferred embodiment of the present invention.
Figure 3:
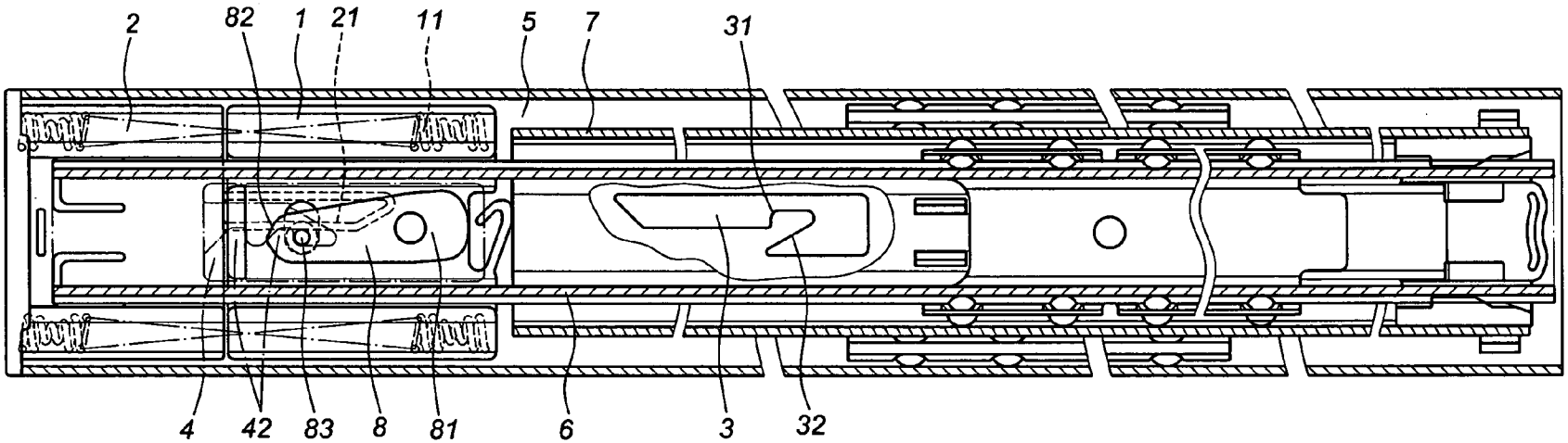
FIG. 3 is a side cross-sectional view showing the preferred embodiment of the present invention in a collapsed status.

As shown in FIGS. 1 through 3, a preferred embodiment of the present invention is applied to a three-section slide assembly which is composed of a stationary rail 5, a relay rail 7 and a sliding rail 6.

The stationary rail 5 has a rail trough 51.

The sliding rail 6 is connected to the stationary rail 5 in a slidable manner.

A sliding member 1 is slidably disposed in the rail trough 51 of the stationary rail 5, and comprises a pair of first elastic members 11 and an engaging plate 8. The engaging plate 8 has a first end 81, a second end 82, an engaging rod 83, and a pivot 84. The first end 81 of the engaging plate 8 is pivotally connected to the sliding member 1 by means of the pivot 84. The engaging rod 83 is disposed on the second end 82 of the engaging plate 8.

A fixture 2 is secured to the end of the stationary rail 5. The fixture 2 and the sliding member 1 are connected by the first elastic members 11.

A locator 3 is disposed in the stationary rail 5, and comprises a recess 31 and a second inclined plane 32 adjacent to the recess 31. The second inclined plane 32 is a guide to lead the engaging rod 83 of the engaging plate 8 to slide along and to stay in the recess 31.

A guiding member 4 is disposed at an inner side of the sliding rail 6, and comprises a first inclined plane 41 and protuberances 42 for engagement of the engaging rod 83 of the engaging plate 8.

The engaging rod 83 of the engaging plate 8 has a locked and released function in connection with the guiding member 4 of the sliding rail 6 and the locator 3 of the stationary rail 5. A second elastic member 21 integrally formed with the fixture 2 will urge the engaging plate 8 to deviate when the sliding member 1 is pulled back towards the fixture 2 by the first elastic members 11.

FIGS. 3 through 6 show the operation of the present invention. FIG. 3 shows the slide assembly is in a collapsed position. When the sliding member 1 is returned to the fixture 2, the engaging rod 83 of the engaging plate 8 is urged by the second elastic member 21 of the fixture 2 while the protuberances 42 of the guiding member 4 in the sliding rail 6 engage with the engaging rod 83 of the engaging plate 8. The guiding member 4 and the sliding member 1 are connected by the engagement of the engaging plate 8. The first elastic members 11 provide a pulling force against the sliding member 1 to force the sliding member 1 to retract into the stationary rail 5 and to secure thereat.

Figure 4:
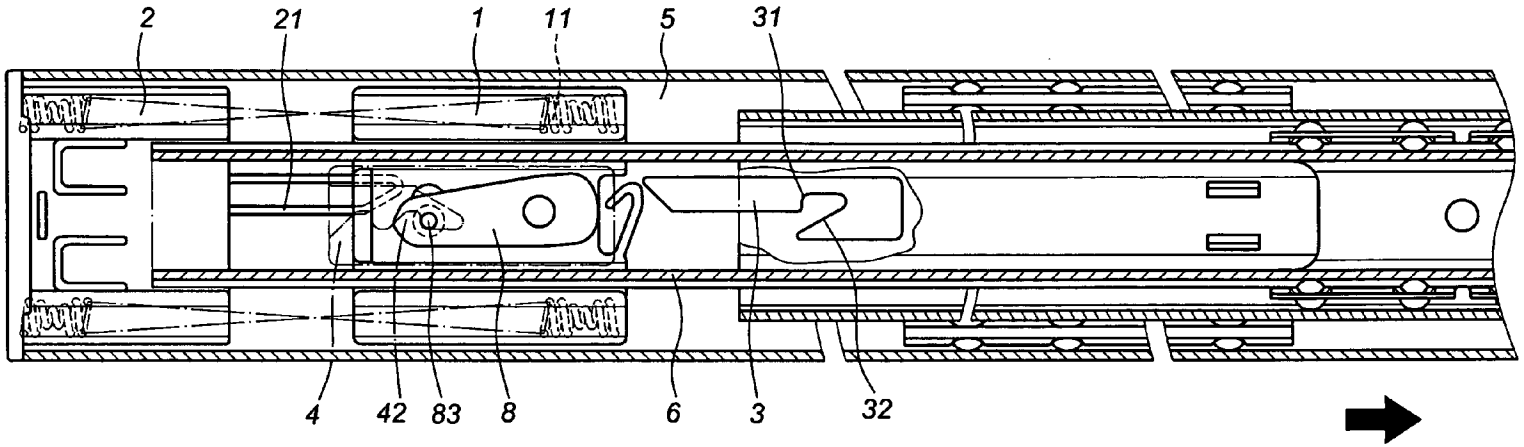
FIG. 4 is a first operational view of the preferred embodiment of the present invention (a sliding member is linked by a guiding member)

As shown in FIG. 4, the sliding rail 6 is pulled outwardly in relation to the stationary rail 5. The sliding member 1 is linked to slide outwardly by the guiding member 4 through the engaging plate 8. The engaging rod 83 of the engaging plate 8 disengages from the second elastic member 21 of the fixture 2.

Figure 5:
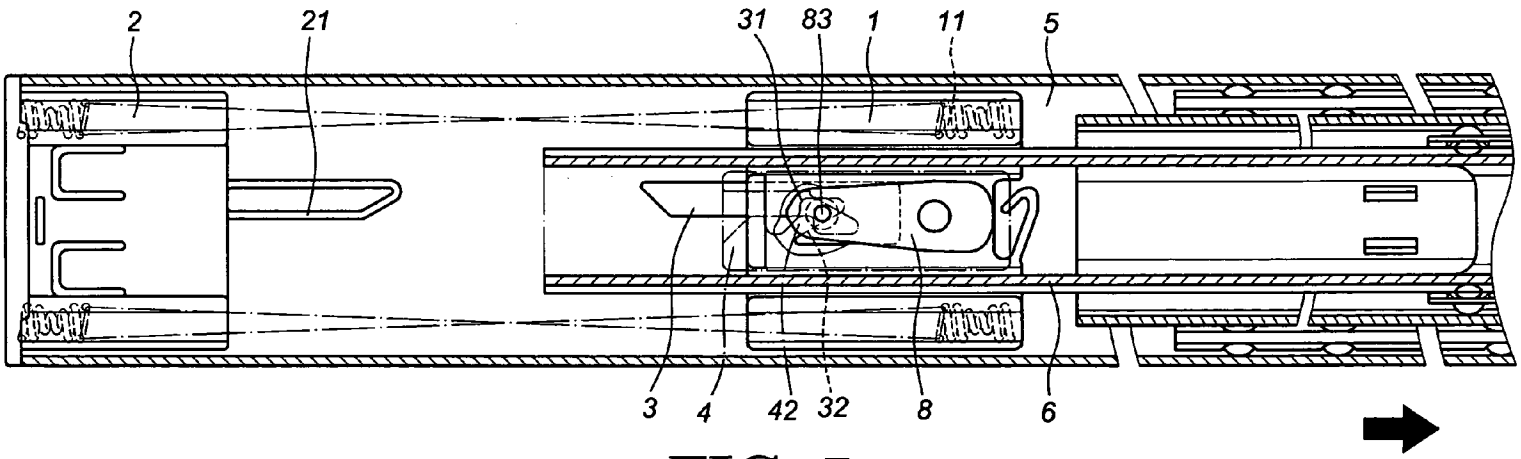
FIG. 5 is a second operational view the preferred embodiment of the present invention (an engaging plate reaches to a locator)

As shown in FIG. 5, when the sliding rail 6 is further pulled in relation to the stationary rail 5, the engaging rod 83 of the engaging plate 8 will engage with the second inclined plane 32 of the locator 3, which guides the engaging rod 83 into the recess 31 of the locator 3.

Figure 6:
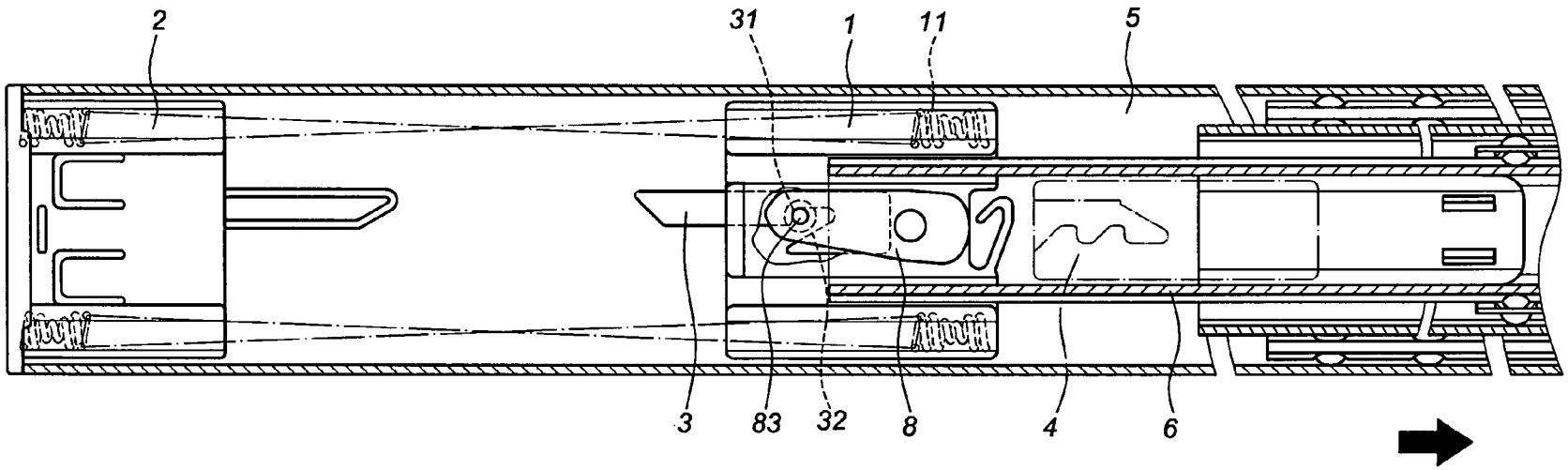
FIG. 6 is a third operational view of the preferred embodiment of the present invention (an engaging rod of an engaging plate engages with a recess of the locator, and the guiding member disengages from the sliding member)

As shown in FIG. 6, when the sliding rail 6 is continually pulled, the engaging rod 83 of the engaging plate 8 is located in the recess 31 to confine the sliding member 1 to stop in the locator 3, and the protuberances 42 of the guiding member 4 disengage from the engaging rod 83 so that the guiding member 4 is linked by the sliding rail 6 to slide.

Figure 7:
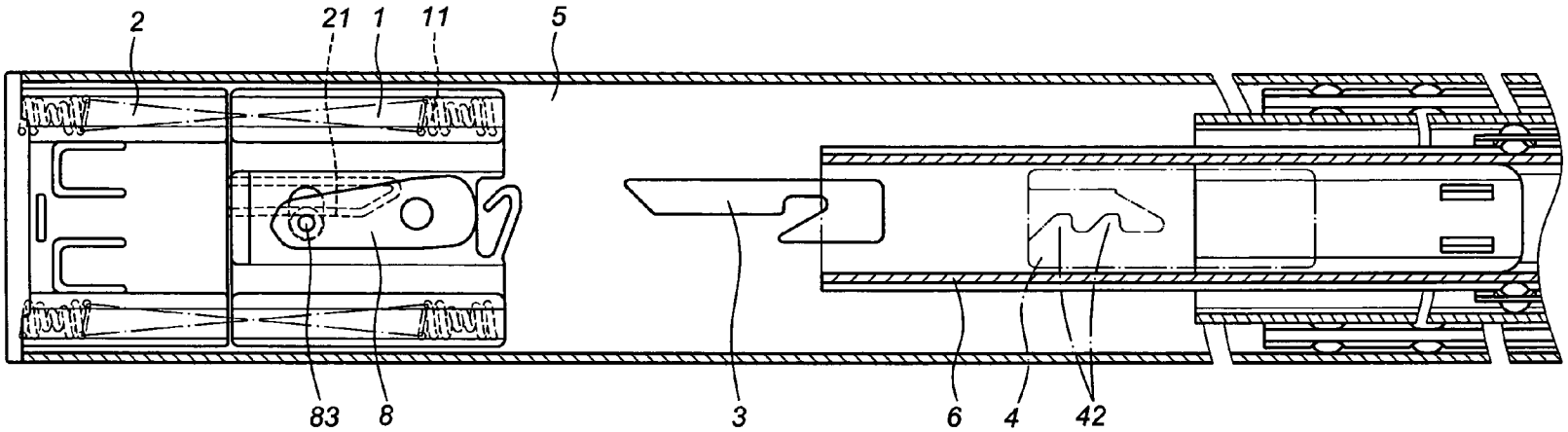
FIG. 7 is a fourth operational view of the preferred embodiment of the present invention (the guiding member is pulled out, but the sliding member is returned to its original position accidentally)
Figure 8:
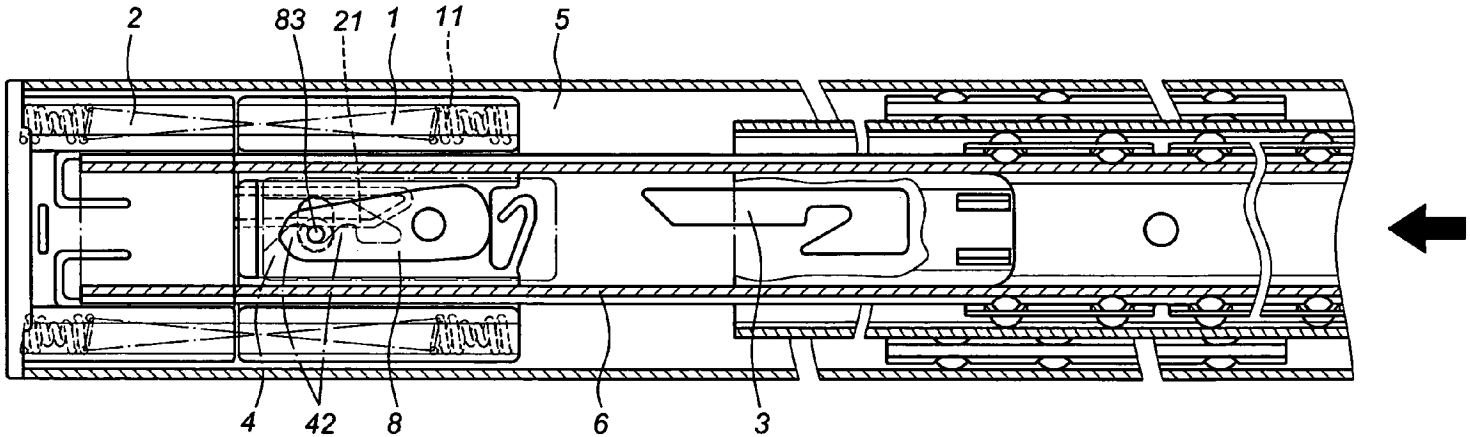
FIG. 8 is a fifth operational view of the preferred embodiment of the present invention (the guiding member is pushed back and then engages with the engaging rod of the engaging plate)

In case the sliding member 1 does not be stopped by the locator 3, such as the sliding member 1 is pulled by the first elastic members 11 to return to the fixture 2 and the engaging rod 83 is urged by the second elastic member 21 at the front of the fixture 2, as shown in FIG. 7. In order to solve these problems, the user may push the sliding rail 6 back to its original position (or to keep the sliding rail 6 at current position and return the sliding rail 6 back to its original position after the job is done), hence the protuberances 42 will be forced to override and engage with the engaging rod 83 because the second elastic member 21 provides a deviating force to the engaging plate 8, as shown in FIG. 8.

Figure 9:
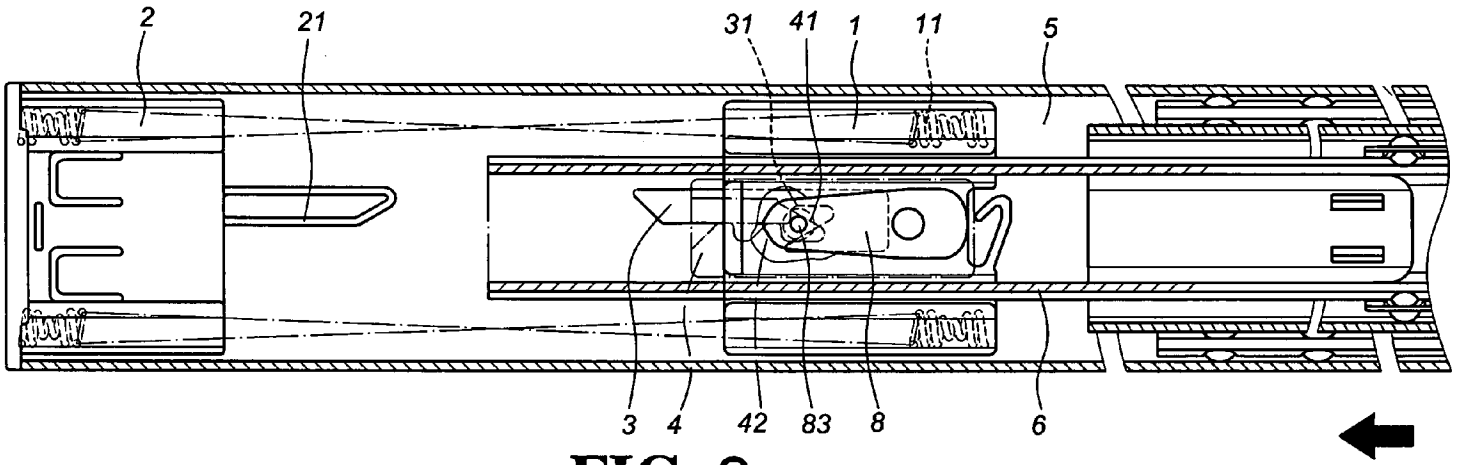
FIG. 9 is a side cross-sectional view showing a collapsed operation of the preferred embodiment of the present invention (a first inclined plane of the guiding member engages with the engaging rod)
Figure 10:
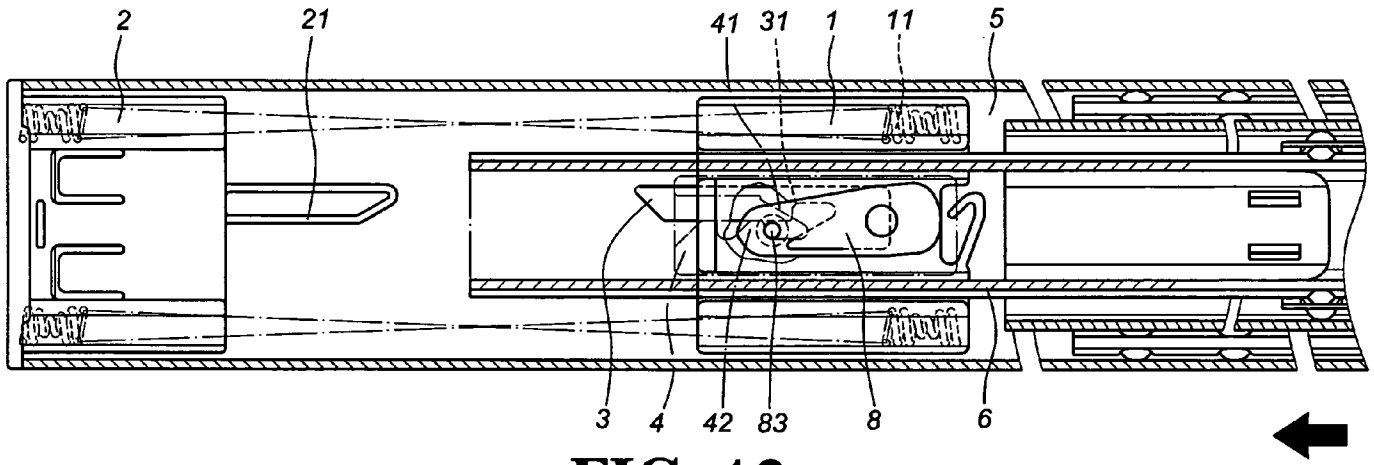
FIG. 10 is a side cross-sectional view showing a collapsed operation of the preferred embodiment of the present invention (the engaging rod engages with protuberances of the guiding member)

As shown in FIG. 9, the sliding rail 6 is pushed inward. When the guiding member 4 reaches to the sliding member 1, the first inclined plane 41 of the guiding member 4 will engage with the engaging rod 83. This engagement will urge the engaging rod 83 to detach from the recess 31 of the locator 3 and then to engage with the protuberances 42 of the guiding member 4. The sliding member 1 is detached from the locator 3 and the sliding rail 6 is urged by the first elastic members 11 to retreat back into the stationary rail 5.

Figure 11:
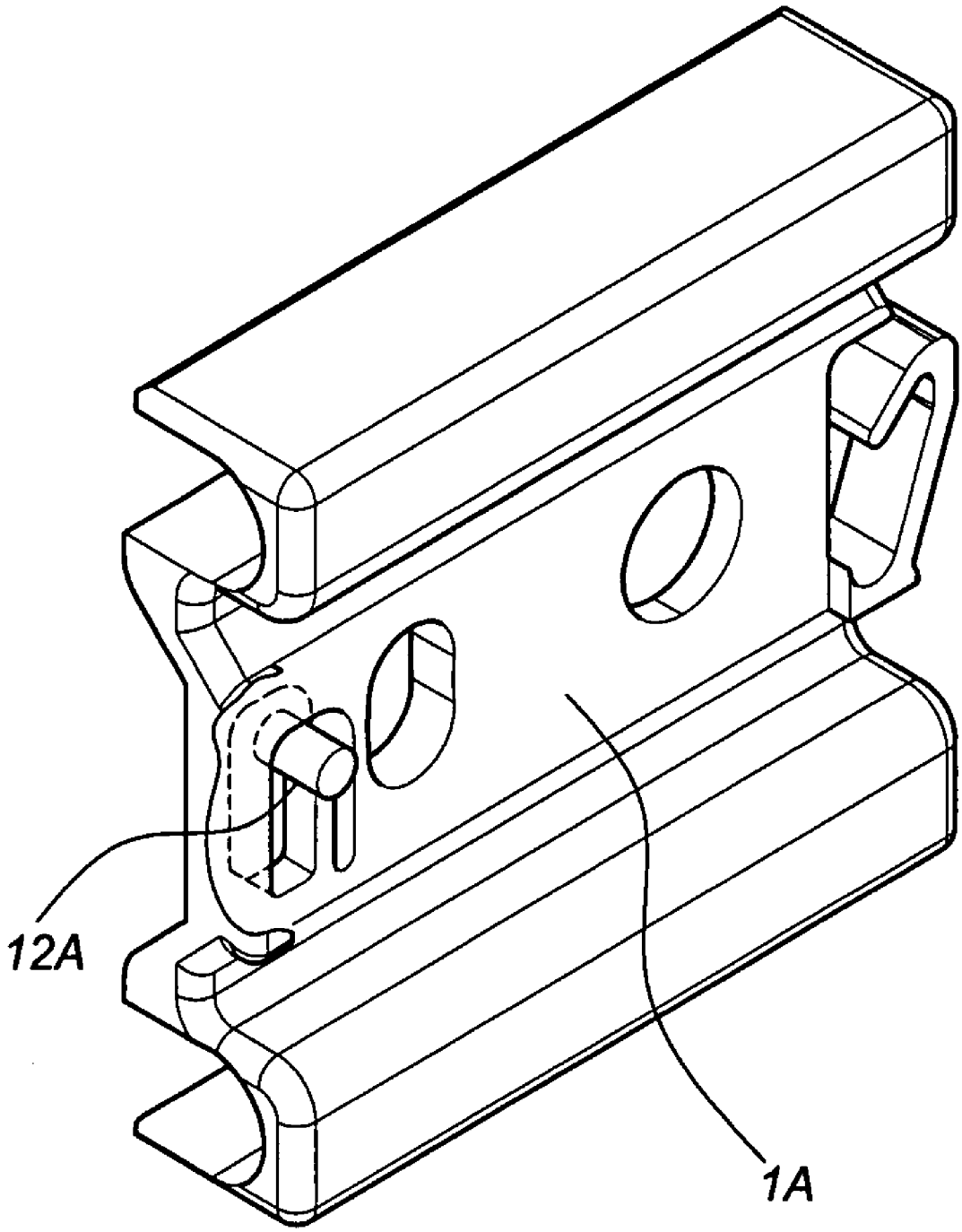
FIG. 11 is a perspective view of another embodiment of the sliding member of the present invention.
Figure 12:
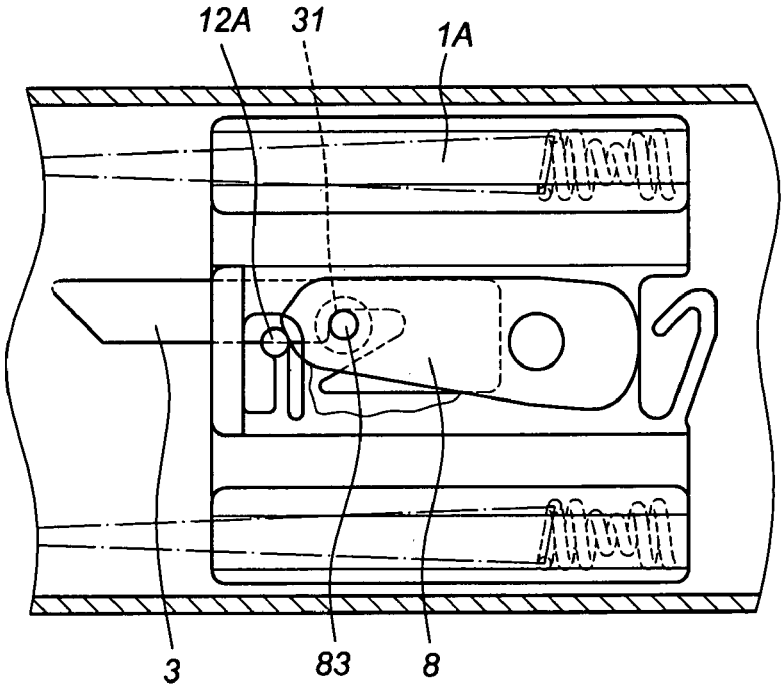
FIG. 12 is a cross-sectional view of the present invention showing the sliding member and the engaging plate in a positioned status (with the second end of the engaging plate facing upward)
Figure 13:
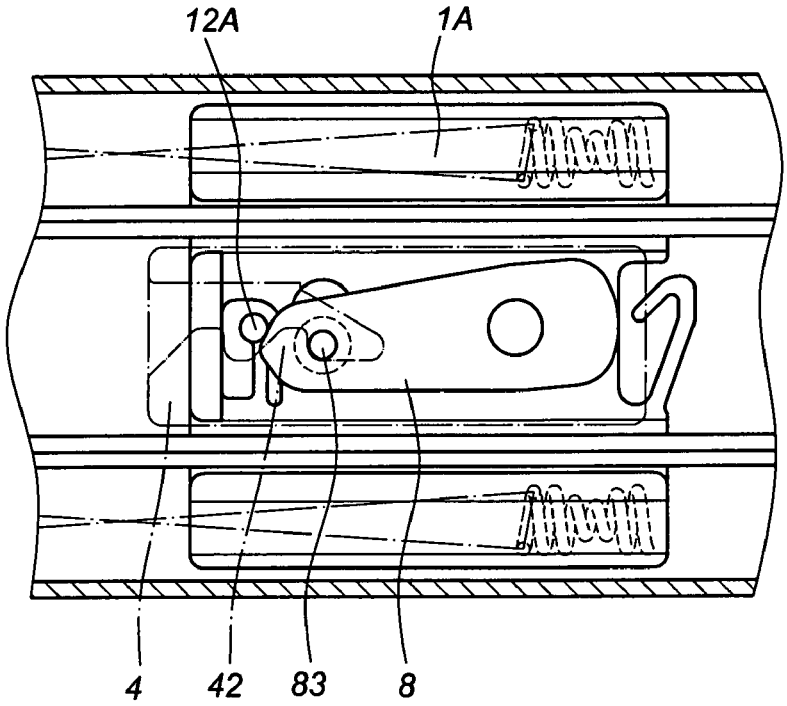
FIG. 13 is a cross-sectional view of the present invention showing the sliding member and the engaging plate in a positioned status (with the second end of the engaging plate facing downward)

FIGS. 11, 12 and 13 show another embodiment of the sliding member 1A which comprises a stopper 12A. The second end 82 of the engaging plate 8 is able to swing and blocked by the stopper 12A at two different locations. One location of the second end 82, as shown in FIG. 12, is in an upper position. The engaging rod 3 engages with the recess 31 of the locator 3. The other position of the second end 82 is in a lower position, as shown in FIG. 13. The engaging rod 83 engages with the protuberances 42 of the guiding member 4.

Figure 14:
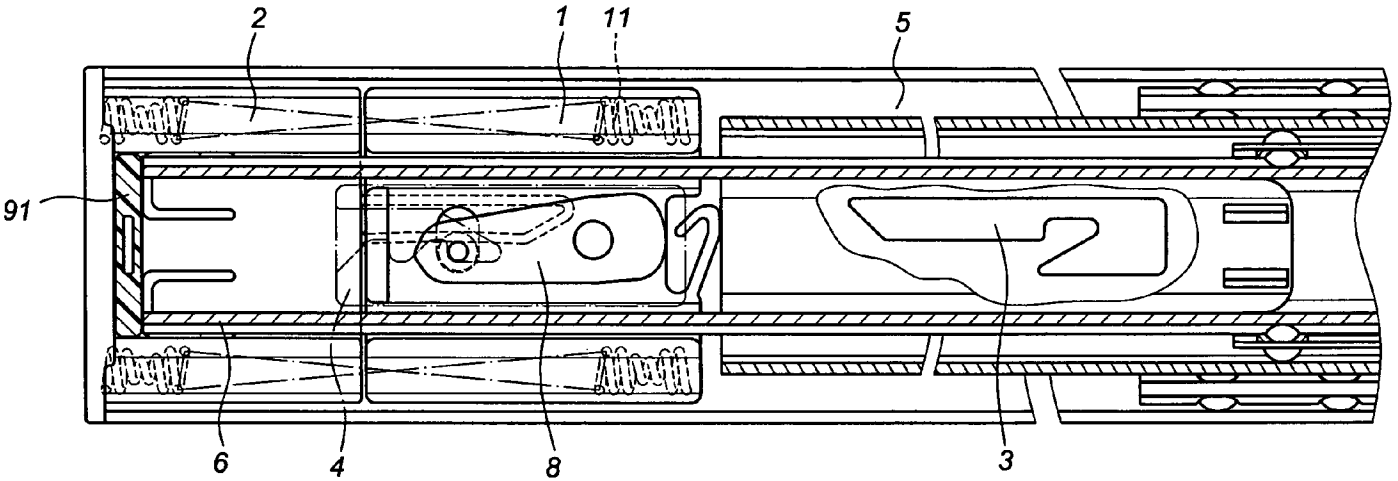
FIG. 14 is a cross-sectional view of the present invention further comprising a buffer (the buffer is a first resilient member disposed between the fixture and the sliding rail)
Figure 15:
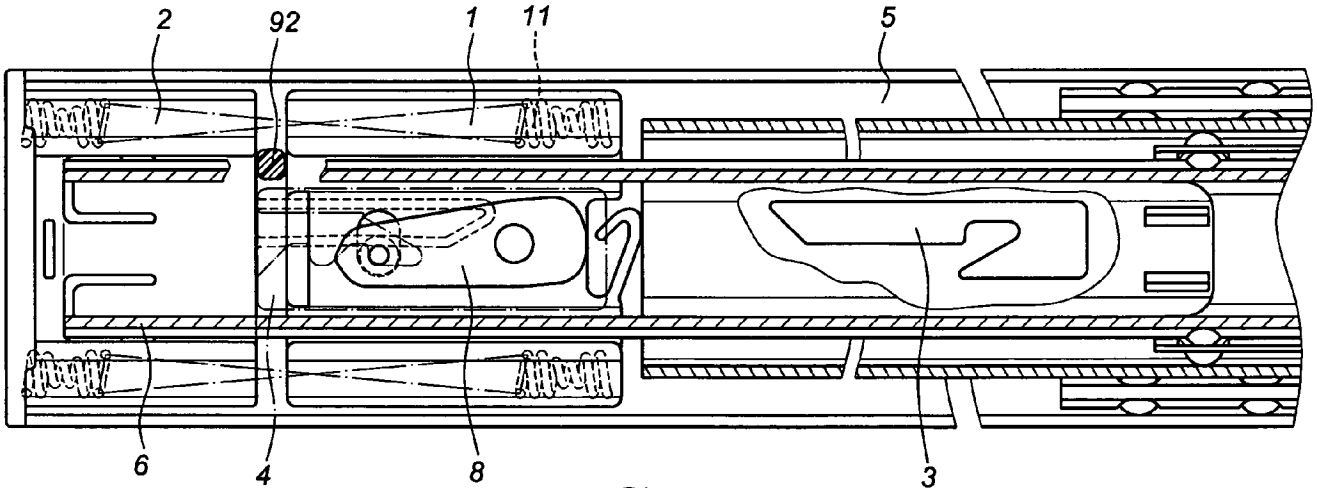
FIG. 15 is a cross-sectional view of the present invention further comprising a buffer (the buffer is a second resilient member disposed between the fixture and sliding member)
Figure 16:
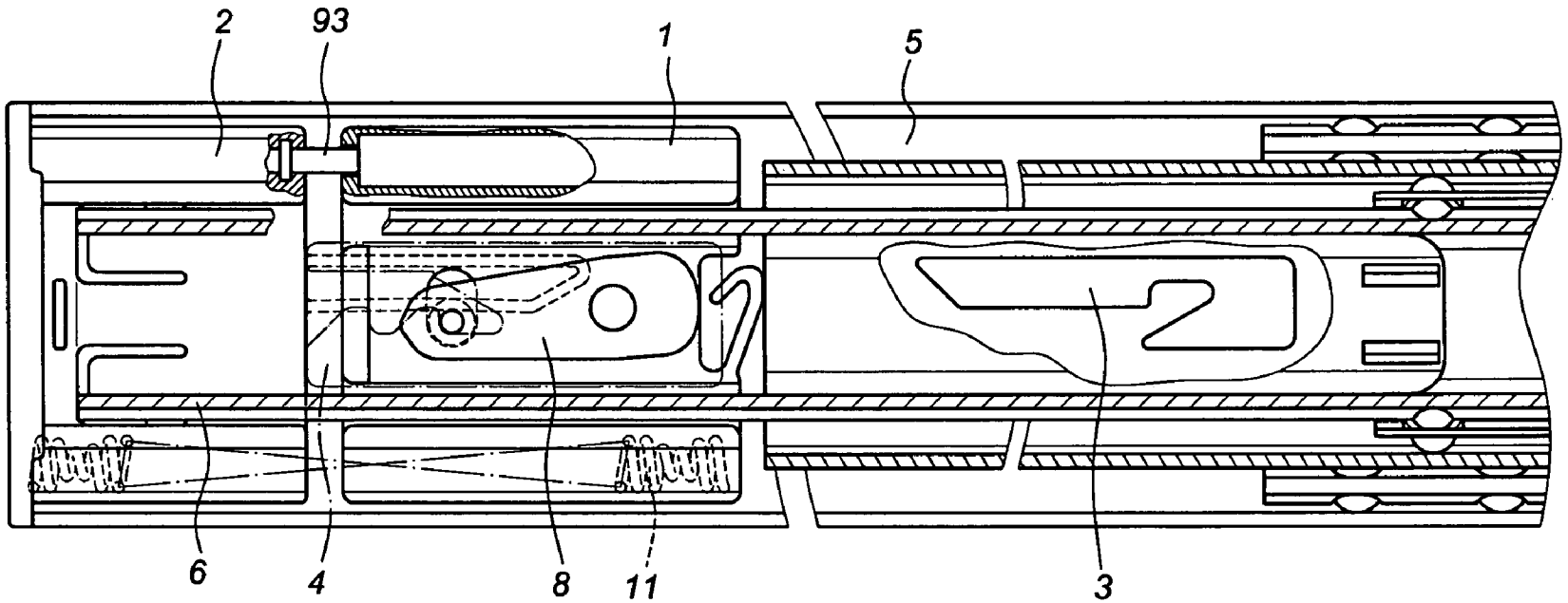
FIG. 16 is a cross-sectional view of the present invention further comprising a buffer (the buffer is a pneumatic or a hydraulic type stick)

As shown in FIGS. 14 through 16, the present invention further comprises a buffer to slow down the striking force of the sliding rail 6 when collapsing and the noise as well. As shown in FIG. 14, a first resilient member 91 is provided between the fixture 2 and the sliding rail 6. As shown in FIG. 15, a second resilient member 92 is provided between the fixture 2 and the sliding member 1. As shown in FIG. 16, a pneumatic or a hydraulic buffer stick 93 is provided between the fixture 2 and the sliding member 1.

Figure 17:
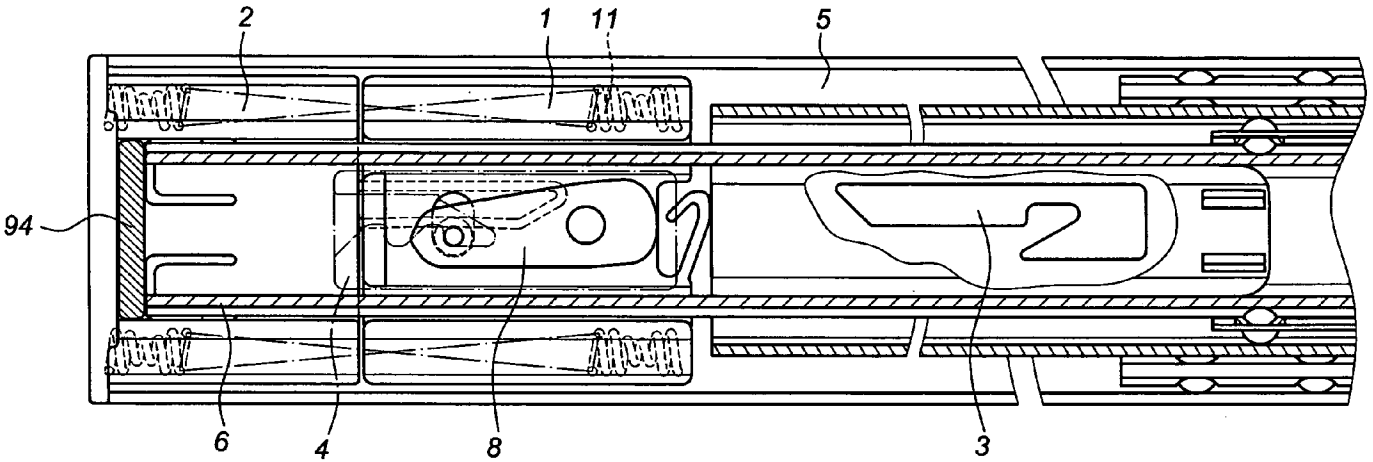
FIG. 17 is a cross-sectional view of the present invention further comprising a magnetic element (the magnetic element is a first magnetic element disposed between the fixture and the sliding rail)
Figure 18:
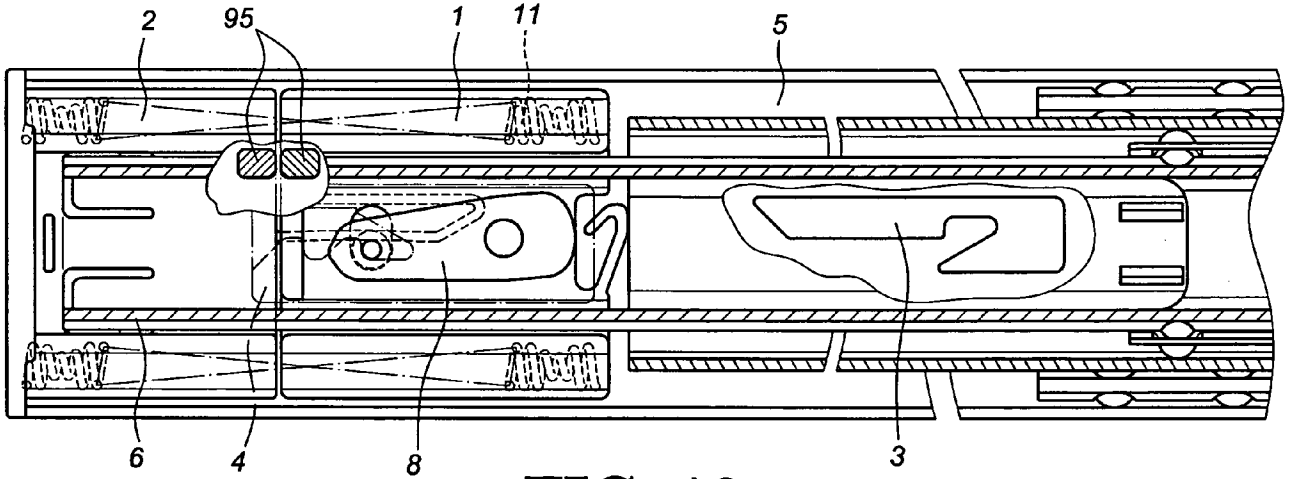
FIG. 18 is a cross-sectional view of the present invention further comprising a magnetic element (the magnetic element is a second magnetic element disposed between the fixture and the sliding member)

The present invention further comprises a magnetic element to secure the sliding rail 6 in a collapsed position. As shown FIG. 17, a first magnetic element 94 is provided between the fixture 2 and the sliding rail 6 to secure the sliding rail 6 made of metallic material. As shown in FIG. 18, second magnetic elements 95 are provided between the fixture 2 and the sliding member 1. The magnetic elements 95 are fixed on relative ends of the fixture 2 and the sliding member 1.

Figure 19:
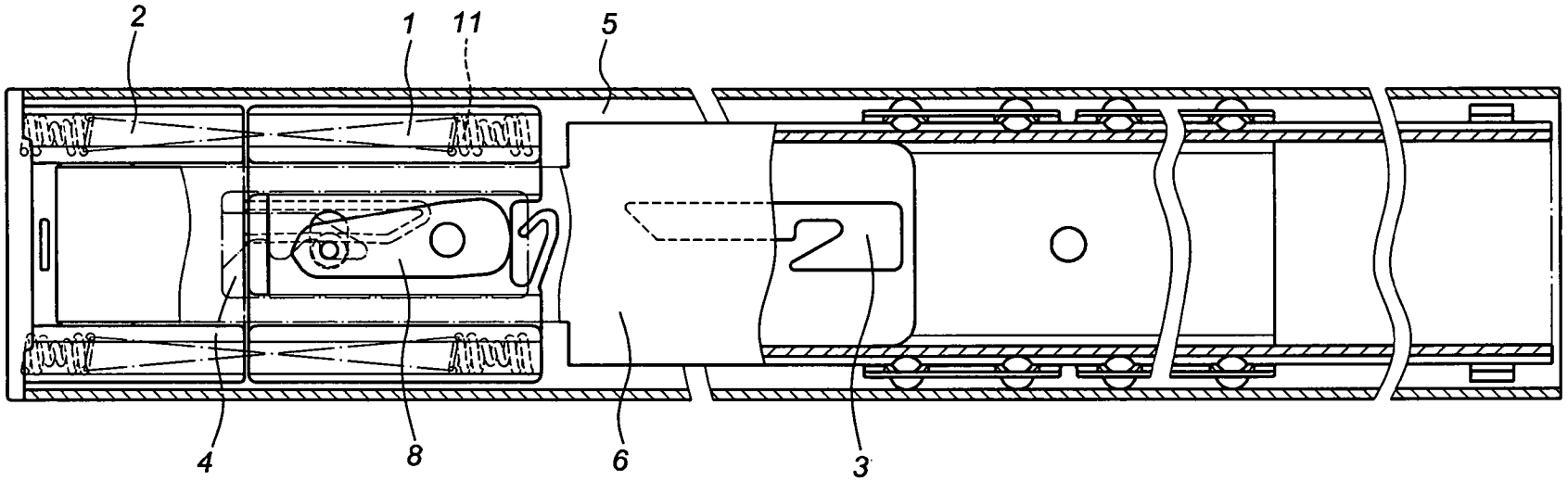
FIG. 19 is a cross-sectional view of the present invention applied to a two-section slide assembly composed of a stationary rail and a sliding rail.

The above description mainly emphasizes a three-section slide assembly having the relay rail 7 between the stationary rail 5 and the sliding rail 6. As shown in FIG. 19, the present invention may be applied to a two-section slide assembly composed of the sliding rail 6 and the stationary rail 5.

Figure 20:
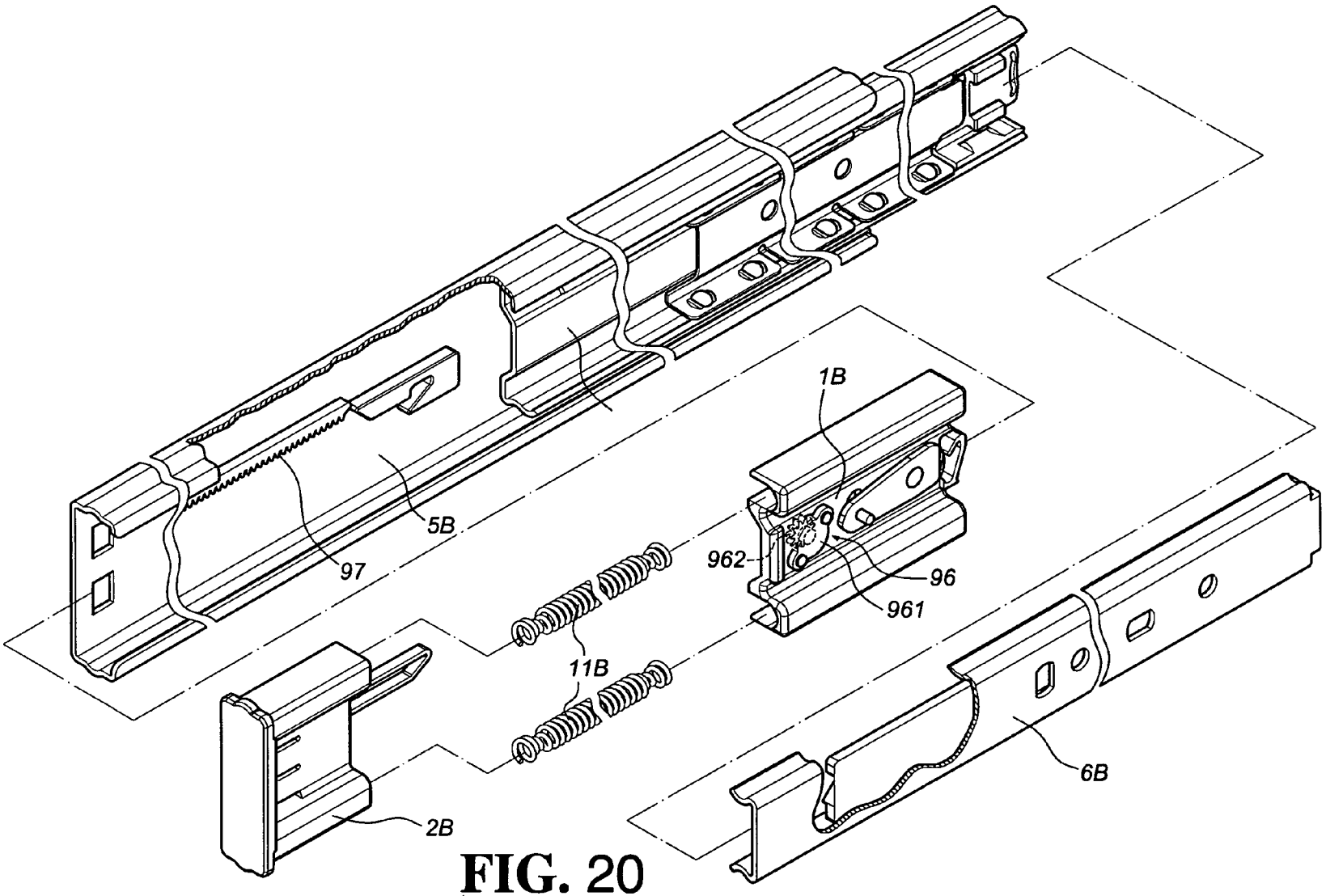
FIG. 20 is an exploded view of the present invention further comprising a damper and a gear chain.
Figure 21:
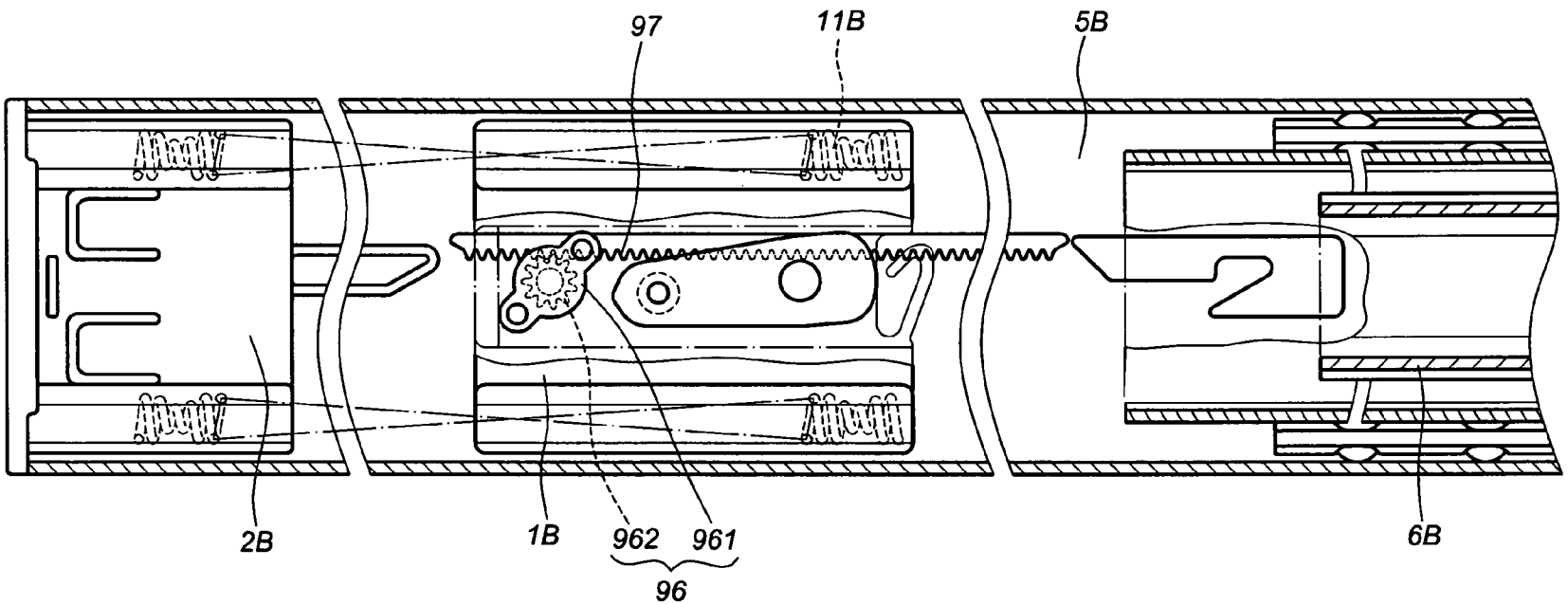
FIG. 21 is a side cross-sectional view of the present invention showing the assembly of the damper and the gear chain.

As shown in FIGS. 20 and 21, the present invention further comprises a damper 96 disposed on a sliding member 1B as a friction when collapsing the sliding rail 6. The damper 96 comprises a case 961 and a gear 962. The case 961 is secured on the sliding member 1B. A gear chain 97 is secured in the stationary rail 5B for meshing with the gear 962. The stationary rail 5B comprises a fixture 2B at a rear end thereof. The fixture 2B and the sliding member 1B are connected by first elastic members 11B.

Figure 22:
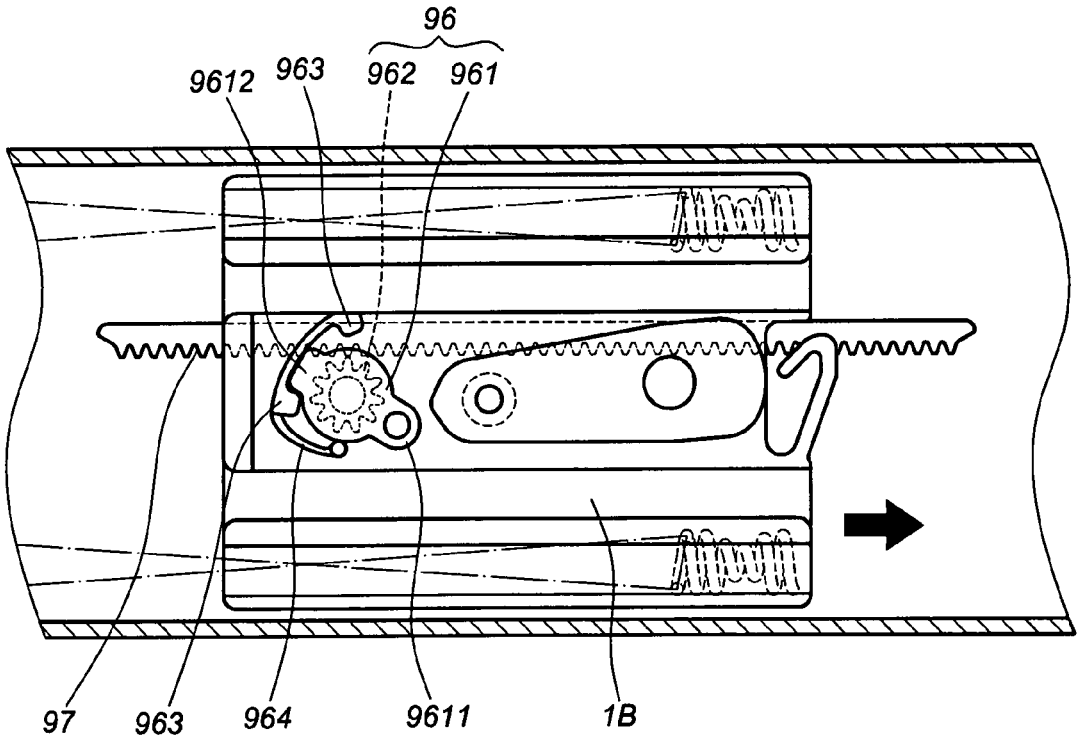
FIG. 22 is a side cross-sectional view of the present invention showing that the damper disengages from the gear chain.
Figure 23:
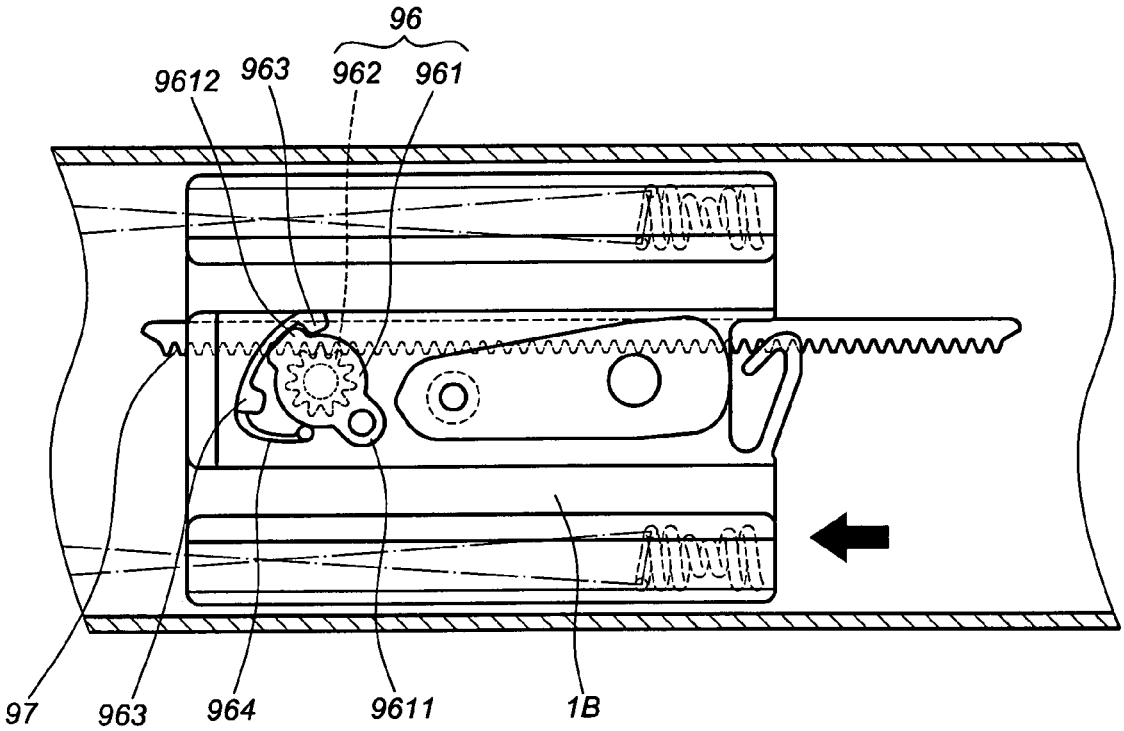
FIG. 23 is a side cross-sectional view of the present invention showing that the damper engages with the gear chain.

As shown in FIGS. 22 and 23, the case 961 of the damper 96 has a connecting end 9611 and an active end 9612. The connecting end 9611 is pivotally connected to the sliding member 1B. The sliding member 1B comprises a restricting member 963 corresponding to the active end 9612 of the case 961 to confine swinging angle of the damper 96. The sliding member 1B further comprises a resilient element 964 corresponding to the damper 96, providing a friction against the gear 962. As shown in FIG. 22, the swing of the damper 96 presses the elastic element 964 to urge the gear 962 detaching from the gear chain 97. When the sliding member 1B returns to its original position, the damper 96 will swing back to its original position where the gear chain 97 meshes with the gear 962, these engagement and disengagement release the friction of the damper 96 when the sliding member 1B is pulled outwardly.

Figure 24:
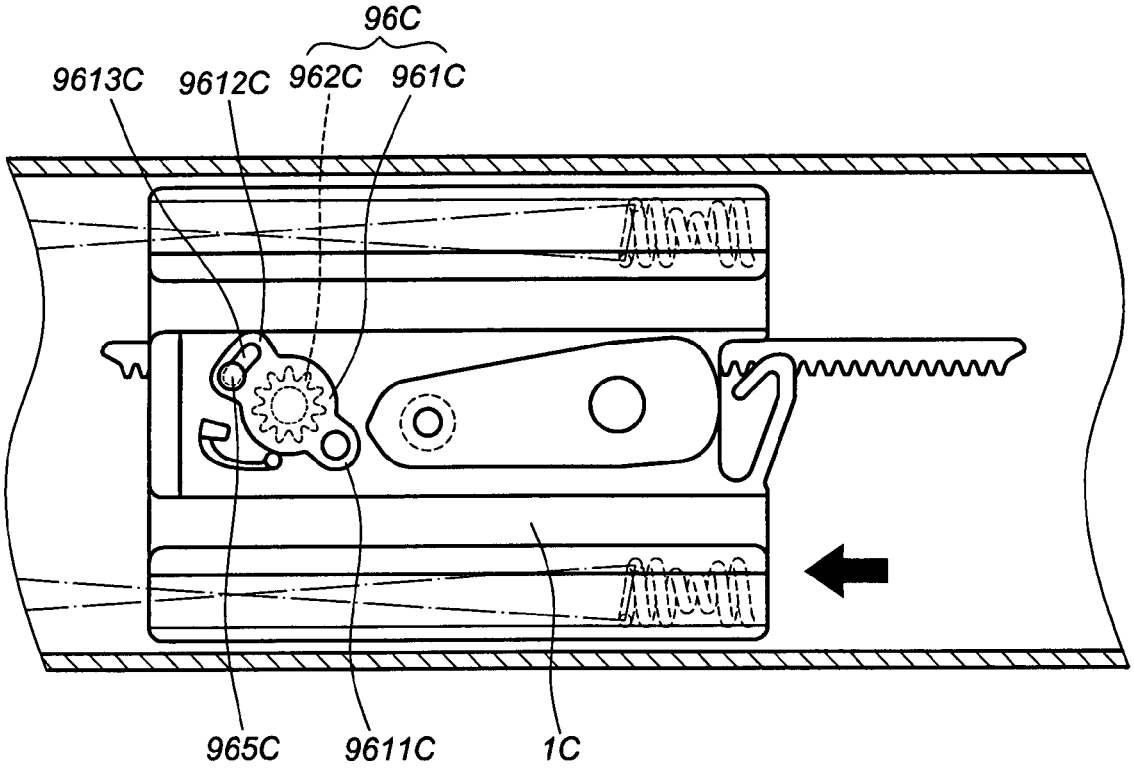
FIG. 24 is a side-cross-sectional view of another embodiment of the damper of the present invention.

Another embodiment of the damper, as shown in FIG. 24, provides a different swing angle of a damper 96C. The damper 96C comprises a case 961C and a gear 962C. The case 961C of the damper 96 has a connecting end 9611C and an active end 9612C. An arc trough 9613C is formed at the active end 9612C corresponding to the connecting end 9611C. A pin 965C penetrating through the arc trough 9613C is secured to a sliding member 1C.

Figure 25:
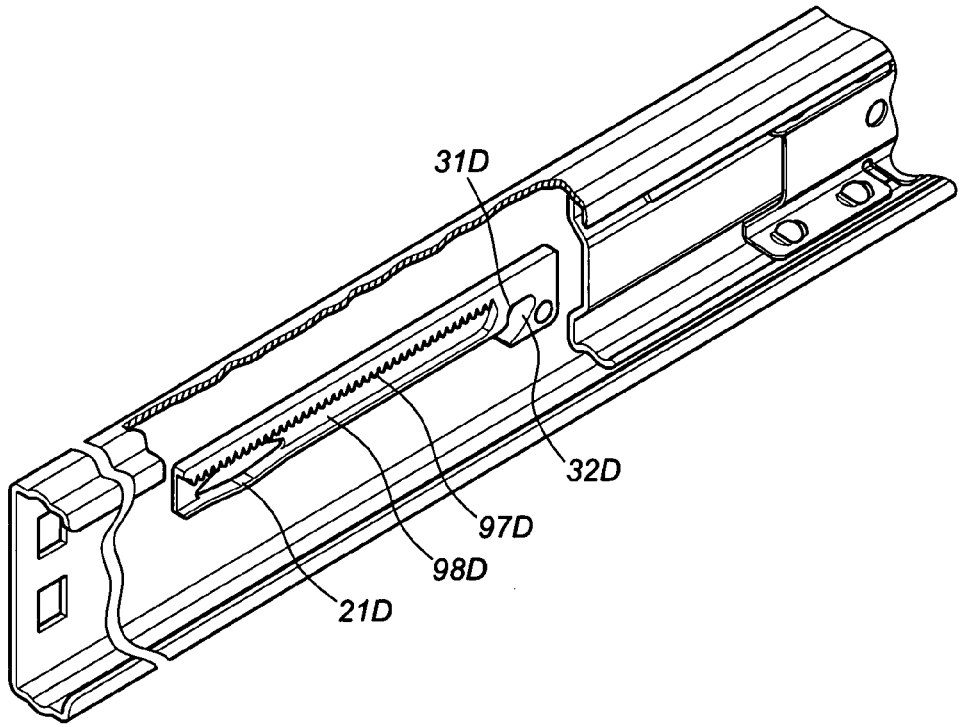
FIG. 25 is a perspective view of a guiding rail of the present invention (the guiding rail comprises a gear chain, a recess, a second inclined plane, and a second elastic member)

As shown in FIG. 25, a gear chain 97D may be formed on a guiding rail 98E. The guiding rail 98E comprises a recess 31D, a second inclined plane 32D adjacent to the recess 31D, and a second elastic member 21D.

Figure 26:
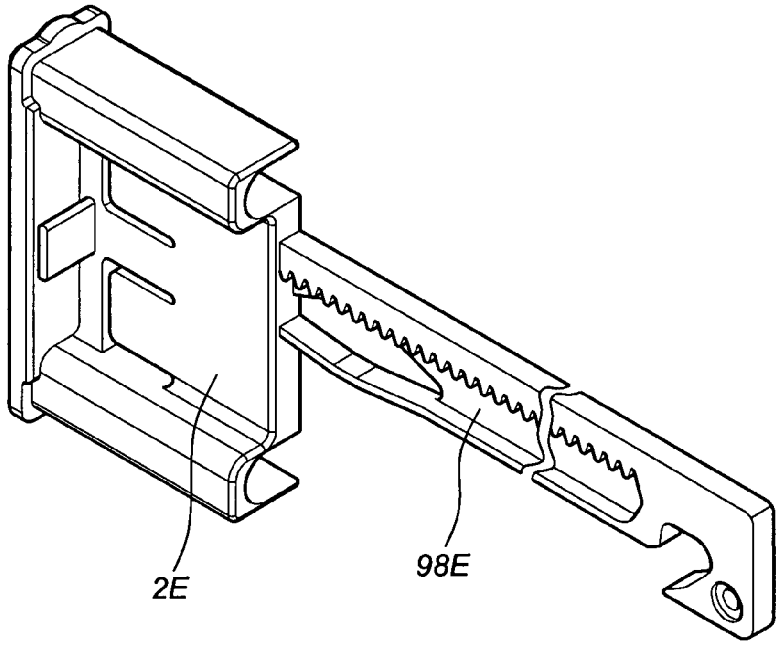
FIG. 26 is a perspective view of the present invention showing that the guiding rail is integrally formed with the fixture.

As shown in FIG. 26, a guiding rail 98E is integrally formed with a fixture 2E.

What is claimed is:

1. A slide assembly having an automatic retractable device, comprising:

a stationary rail having a rail trough;

a sliding rail slidably connected to said stationary rail;

a sliding member disposed in said rail trough of said stationary rail in a slidable manner, said sliding member comprising a first elastic member and an engaging plate, said engaging plate comprising a first end, a second end, and an engaging rod, said first end of said engaging plate being pivotally connected to said sliding member, said engaging rod being disposed on said second end of said engaging plate to be displaceable therewith between a plurality of engaging positions about said first end pivotal connection;

a fixture disposed at one end of said stationary rail, said fixture and said sliding member being connected by said first elastic member;

a locator disposed in said stationary rail, said locator comprising a recess and a second inclined plane adjacent to said recess, said engaging rod of said engaging plate being secured in said recess along said second inclined plane when in a first of the engaging positions; and a guiding member disposed at an inner side of said sliding rail, said guiding member comprising a first inclined plane and protuberances, said engaging rod of said engaging plate engaging said guiding member when in a second of the engaging positions.

2. The slide assembly having an automatic retractable device, as recited in claim 1, wherein said fixture comprises a second elastic member corresponding to said second end of said engaging plate.

3. The slide assembly having an automatic retractable device, as recited in claim 2, wherein said second elastic member is an elastic rod.

4. The slide assembly having an automatic retractable device, as recited in claim 1, wherein said sliding member comprises a stopper corresponding to said second end of said engaging plate.

5. The slide assembly having an automatic retractable device, as recited in claim 1, further comprising a buffer disposed either between said fixture and said sliding rail or between said fixture and said sliding member.

6. The slide assembly having an automatic retractable device, as recited in claim 5, wherein said buffer is a resilient member.

7. The slide assembly having an automatic retractable device, as recited in claim 5, wherein said buffer is a pneumatic buffer rod.

8. The slide assembly having an automatic retractable device, as recited in claim 1, further comprising a magnetic element disposed either between said fixture and said sliding rail or between said fixture and said sliding member.

9. The slide assembly having an automatic retractable device, as recited in claim 1, further comprising a damper and a gear chain, said damper comprising a case and a gear, said damper being disposed on said sliding member, said gear chain being disposed on said stationary rail, said gear of said damper meshing with said gear chain.

10. The slide assembly having an automatic retractable device, as recited in claim 9, wherein said case of said damper is fixedly connected to said sliding member.

11. The slide assembly having an automatic retractable device, as recited in claim 9, wherein one end of said case of said damper is pivotally connected said sliding member to facilitate engagement and disengagement of said gear chain and said gear.

12. The slide assembly having an automatic retractable device, as recited in claim 11, wherein said sliding member comprises a restricting member corresponding to said case of said damper to confine swinging angle of said damper, said sliding member further comprising a resilient element corresponding to said damper.

13. The slide assembly having an automatic retractable device, as recited in claim 11, wherein said case comprises an arc trough and a pin penetrating said arc trough to be secured to said sliding member.

14. The slide assembly having an automatic retractable device, as recited in claim 9, wherein said gear chain is formed on a guiding rail, said guiding rail comprising a recess, a second inclined plane adjacent to said recess, and a second elastic member.

15. The slide assembly having an automatic retractable device, as recited in claim 14, wherein said guiding rail is integrally formed with said fixture.

* * * * *